US006473923B1

(12) United States Patent
Straub

(10) Patent No.: US 6,473,923 B1
(45) Date of Patent: Nov. 5, 2002

(54) INFANT POSITIONER FOR REDUCING RISK OF POSITIONAL PLAGIOCEPHALY

(76) Inventor: Mariann C. Straub, 1185 Chatfield, Winnetka, IL (US) 60093

( * ) Notice: Subject to any disclaimer, the term of this patent is extended or adjusted under 35 U.S.C. 154(b) by 0 days.

(21) Appl. No.: 09/718,987

(22) Filed: Nov. 22, 2000

Related U.S. Application Data

(63) Continuation of application No. 29/127,112, filed on Jul. 31, 2000, now Pat. No. Des. 446,675.

(51) Int. Cl.[7] ..... A47D 13/08; A47G 9/06
(52) U.S. Cl. ..... 5/655; 5/425; 5/922
(58) Field of Search ..... 5/655, 424, 425, 5/427, 417, 419, 420, 922; D6/595, 596, 601, 333

(56) References Cited

U.S. PATENT DOCUMENTS

| | | | | | |
|---|---|---|---|---|---|
| 2,562,725 | A | | 7/1951 | Leto et al. | 5/631 |
| 2,644,173 | A | * | 7/1953 | James | 5/425 |
| D220,953 | S | * | 6/1971 | Des Pres | 5/427 X |
| 3,924,282 | A | | 12/1975 | Bond | 5/632 |
| 4,383,713 | A | * | 5/1983 | Roston | 5/655 X |
| 4,506,396 | A | | 3/1985 | Ritchie, Jr. et al. | 5/631 |
| 4,607,402 | A | * | 8/1986 | Pollard | 5/425 |
| 4,733,836 | A | | 3/1988 | Barnes | 248/106 |
| 4,771,493 | A | | 9/1988 | Park | 5/637 |
| D300,694 | S | * | 4/1989 | Krok | D6/333 |
| 4,862,535 | A | | 9/1989 | Roberts | 5/655 |
| 5,165,130 | A | | 11/1992 | Wendling | 5/655 |
| 5,189,748 | A | | 3/1993 | Garrison et al. | 5/655 |
| 5,193,238 | A | | 3/1993 | Clute | 5/655 |
| 5,272,780 | A | | 12/1993 | Clute | 5/655 |
| D343,756 | S | | 2/1994 | Sher | D6/601 |
| 5,310,245 | A | * | 5/1994 | Lyszczasz | 5/655 X |
| 5,341,531 | A | * | 8/1994 | Straub et al. | 5/655 |
| D369,054 | S | * | 4/1996 | Straub et al. | D6/601 |
| D369,934 | S | * | 5/1996 | Straub et al. | D6/596 |
| D372,160 | S | * | 7/1996 | Morgan | D6/601 |
| D385,143 | S | * | 10/1997 | Straub et al. | D6/601 |
| D408,676 | S | * | 4/1999 | Straub et al. | D6/601 |
| 5,916,089 | A | * | 6/1999 | Ive | 5/655 |
| D440,805 | S | * | 4/2001 | Rogone et al. | D6/596 |
| D446,675 | S | * | 8/2001 | Straub | D6/601 |
| D448,227 | S | * | 9/2001 | Straub | D6/601 |

* cited by examiner

*Primary Examiner*—Robert G. Santos
(74) *Attorney, Agent, or Firm*—Olson & Hierl, Ltd.

(57) ABSTRACT

An infant positioner positions an infant in a supine position for sleeping and reduces the risk of developing positional plagiocephaly. The infant positioner includes a mat for supporting the torso of an infant. A first body pillow is attached to the mat, and a second body pillow is attached to the mat in spaced relationship with the first body pillow. A head positioner is attached to the mat for supporting the head of the infant lying supine on the mat between the first and second body pillows. The head positioner has at least one upper surface that slopes transversely such that the infant's head is caused to rotate to the side while sleeping in the supine position.

7 Claims, 2 Drawing Sheets

INFANT POSITIONER FOR REDUCING RISK OF POSITIONAL PLAGIOCEPHALY

This application is a continuation-in-part of U.S. patent application Ser. No. 29/127,112 filed Jul. 31, 2000, now U.S. Design Patent No. D446,675 issued Aug. 21, 2001.

FIELD OF THE INVENTION

This application relates generally to devices for positioning an infant while sleeping, and relates more particularly to an infant positioner for reducing the risk of sudden infant death while also reducing the risk of positional plagiocephaly, i.e., a flattened or misshapen region of the skull.

BACKGROUND OF THE INVENTION

Medical studies have shown that infants who sleep on their backs or sides have a reduced risk of dying suddenly from Sudden Infant Death Syndrome (SIDS), compared to infants who sleep on their stomachs. Efforts by the American Academy of Pediatrics to disseminate this information to pediatricians and parents has resulted in an increase in the practice of placing infants in a supine position, i.e., on their backs for sleeping. A decrease in the incidence of SIDS has been observed in recent years.

An unanticipated effect of the increasingly widespread practice of placing infants in a supine position for sleeping has been an increase in the number of infants developing positional plagiocephaly, i.e., a flat or misshapen area on the back of the skull. A newborn infant's skull is relatively deformable due to flexibility of the bone plates and non-fusion of the sutures between adjacent bone plates. This property of deformability permits the child's head to pass between the bones of the mother's pelvis during birth. As the infant matures, however, the bone plates of the skull become increasingly rigid and the sutures eventually fuse.

When an infant spends many hours daily sleeping exclusively on its back, the bones at the back of the skull tend to flatten from pressure against the sleeping surface due to the weight of the child's head. If the practice of sleeping exclusively on the back is continued through the critical period during which the bones of the skull become rigid, the flat or misshapen area on the back of the skull can become permanent.

It would be desirable to provide a structure that maintains the position of an infant on its back during sleep to gain the benefit of reducing the risk of dying from SIDS, but that also reduces the risk of the infant developing positional plagiocephaly. This and other desirable benefits are provided by the present invention described below in terms of a preferred embodiment.

SUMMARY OF THE INVENTION

An infant positioner is provided for positioning an infant in a supine position for sleeping. The infant positioner also reduces the risk of developing positional plagiocephaly in an infant sleeping in a supine position. The infant positioner includes a mat, a first body pillow attached to the mat, and a second body pillow attached to the mat in spaced relationship with the first body pillow. The spacing accommodates an infant's torso lying in a supine position on the mat between the first and second body pillows. A head positioner is attached to the mat for supporting the head of an infant lying supine on the mat between the first and second body pillows. The head positioner has at least one upper surface that slopes transversely such that the infant's head is caused to rotate to the side while sleeping in the supine position.

Other advantages of the present invention will be apparent from the description of preferred embodiments, made with reference to the drawings, that follows.

DETAILED DESCRIPTION OF THE PREFERRED EMBODIMENTS

Figure 1:
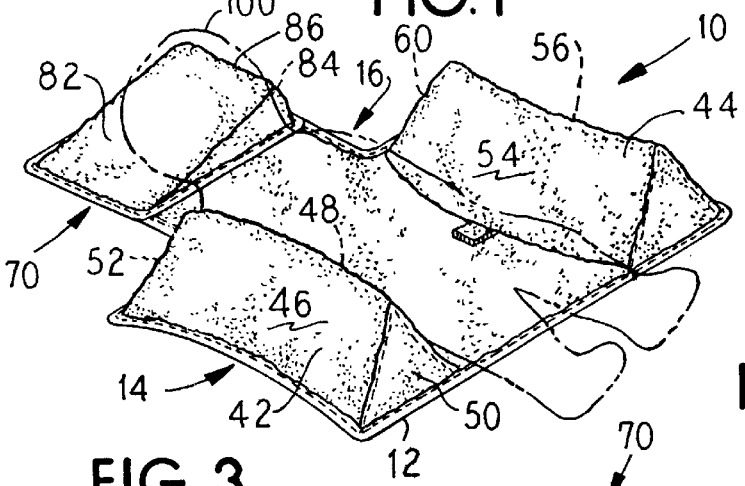
FIG. 1 is a perspective view of a first embodiment of an infant positioner configured in accordance with the present invention.
Figure 2:
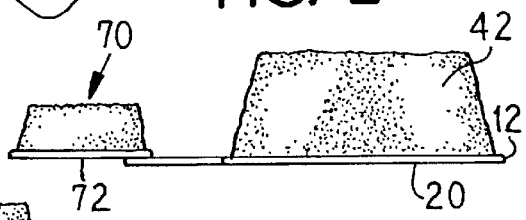
FIG. 2 is a side elevational view of the infant positioner of FIG. 1.
Figure 3:
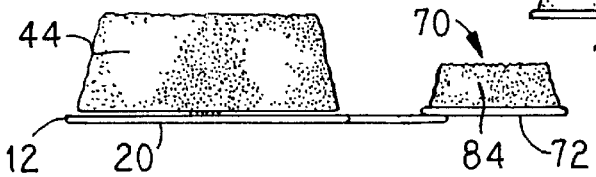
FIG. 3 is an opposite side elevational view of the infant positioner of FIG. 1.
Figure 4:
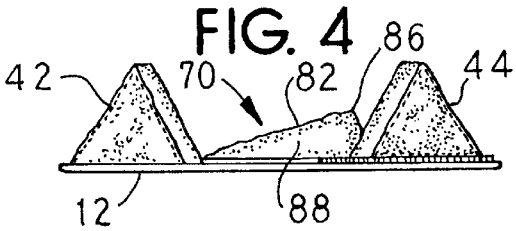
FIG. 4 is a foot end view of the infant positioner of FIG. 1.
Figure 5:
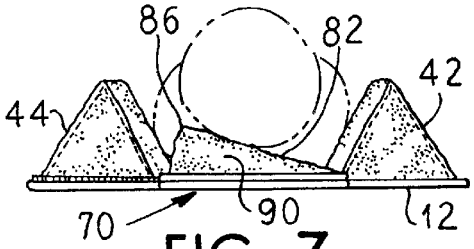
FIG. 5 is a head end view of the infant positioner of FIG. 1.
Figure 6:
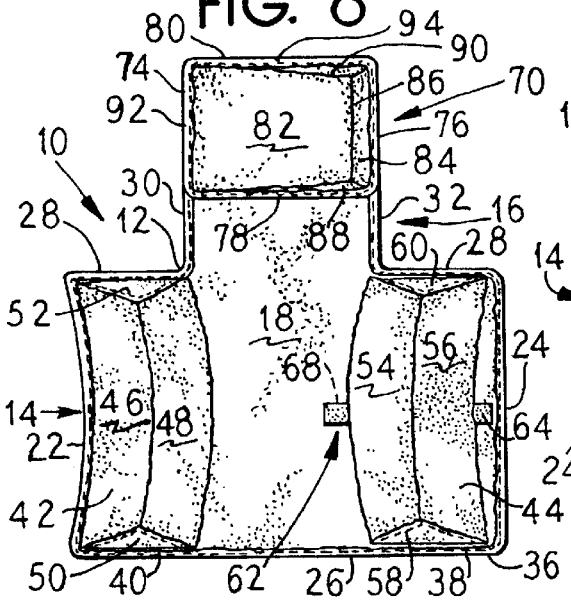
FIG. 6 is a top plan view of the infant positioner of FIG. 1.
Figure 7:
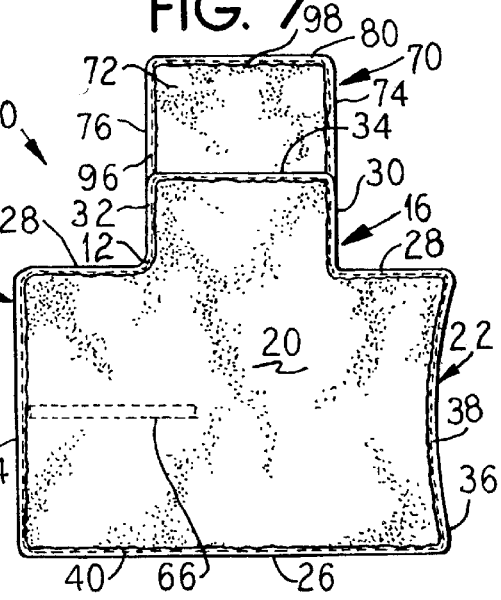
FIG. 7 is a bottom plan view of the infant positioner of FIG. 1.

Referring to FIGS. 1–7, there is illustrated a first embodiment of an infant positioner 10 constructed in accordance with the present invention.

The infant positioner 10 includes a mat 12 comprising a woven or non-woven fabric. As preferred, mat 10 is constructed of cotton terry cloth or cotton flannel which, advantageously, is soft, liquid absorbent, sewable, conventionally washable, low in cost, and has a non-slip surface. All of these advantages make this material well suited for use with an infant. Mat 12 has a body portion 14 that is generally rectangular in shape, and a head portion 16 that is of lesser width than body portion 14 and that extends therefrom.

Overall, mat 12 is somewhat T-shaped with head portion 16 forming the stem of the T and with body portion 14 forming the cross-bar of the T. Body portion 14 is defined by a top surface 18, an opposite bottom surface 20, opposite side edges 22 and 24, foot edge 26, and shoulder edge 28. Head portion 16 is defined by top surface 18 and bottom surface 20 shared with body portion 14, by opposite side edges 30 and 32, and by head edge 34.

Shoulder edge 28 is interrupted by head portion 16 and side edges 30 and 32, which extend therefrom. Each of edges 24, 26, 28, 30, 32 and 34 is generally straight, whereas edge 22 is slightly curved concavely. Edges 22, 24, 30 and 32 are generally parallel to each other. Edges 26, 28 and 34 are generally parallel to each other and generally perpendicular to edges 22, 24, 30 and 32. Edges 22, 24, 26, 28, 30, 32 and 34 together form a continuous perimeter edge 36 of mat 12 that is bound against ravelling by a single length of binding tape 38. The perimeter edge 36 is overlapped by binding tape 38 which is folded lengthwise and stitched to mat 12 at stitch line 40. Binding tape 38 preferably comprises a woven fabric of synthetic material such as polyester or the like.

Infant positioner 10 also includes a pair of body pillows 42 and 44. First body pillow 42 is permanently attached to mat 12, whereas second body pillow 44 is movably attachable to mat 12 in a range of positions to facilitate adjusting the fit of infant positioner 10 to an individual infant, as described further below. First body pillow 42 is elongated, resilient, elastomeric, compressible and shape-retaining. Lengthwise, first body pillow 42 is slightly curved in a curvature that substantially matches the curvature of side 22 of mat 12. In transverse cross-section, first body pillow 42 preferably has the configuration of an equilateral triangle. Other triangular configurations can be used, if desired. Also, first body pillow 42 can have alternative cross-sectional configurations, if desired, including other polygonal shapes such as, for example, a trapezoid, or rounded semi-circular, semi-elliptical, or semi-oval configurations. It is preferred to use a cross-sectional configuration for first body pillow 42 having at least one flat side adjacent mat 12 to achieve a desired stable relationship with mat 12.

First body pillow 42 has two exposed, longitudinal upper faces 46 and 48, a triangular foot end 50 and a triangular shoulder end 52. The third longitudinal face of pillow 42 lies adjacent mat 12. Upper faces 46 and 48 and triangular ends 50 and 52 are covered with the same or similar fabric material, preferably terry cloth or cotton flannel, from which mat 12 is constructed. The core of body pillow 42 is preferably polyurethane foam. Other materials are also contemplated such as, for example, polyester fiber fill. When a polyurethane foam is used, a conventional hot water and detergent washing procedure for infant positioner 10 may not be desirable because of the heat sensitivity of foams in common use. Washing in cold or warm water would be more preferred.

The fabric covering faces 46 and 48 and ends 50 and 52 of first body pillow 42 is preferably sewn to the fabric of mat 12 to retain first body pillow 42 in a fixed location and orientation with respect to mat 12. More specifically, first body pillow 42 is disposed with one longitudinal apex closely adjacent concavely curved side edge 22, with body pillow 42 also being curved concavely as viewed from a point offset away from side edge 22 of mat 12. Viewed from the opposite direction, i.e., from a point near the center of body portion 14 of mat 12, body pillow 42 would appear to be curved convexly.

Second body pillow 44 is substantially similar in shape to first body pillow 42, and is likewise elongated, resilient, elastomeric, compressible and shape-retaining. Lengthwise, second body pillow 44 is slightly curved in a curvature that substantially matches the curvature of first body pillow 42, but the direction of curvature is opposite to that of first body pillow 42. In transverse cross-section, second body pillow 44 preferably has the configuration of an equilateral triangle. Other cross-sectional configurations, as described above with respect to first body pillow 42, can be used if desired. Second body pillow 44 has at least one flat side adjacent mat 12 for stability, similar to first body pillow 42, but is not permanently attached in a fixed position to mat 12, as described further below.

Second body pillow 44 has two exposed, longitudinal upper faces 54 and 56, a triangular foot end 58 and a triangular shoulder end 60. The third longitudinal face of pillow 44 lies adjacent mat 12. As with first body pillow 42, upper faces 54 and 56 and triangular ends 58 and 60 are covered with the same or similar fabric material, preferably terry cloth or cotton flannel, from which mat 12 is constructed. Like first body pillow 42, the core of second body pillow 44 is preferably polyurethane foam, but other materials are also contemplated such as, for example, polyester fiber fill.

The fabric covering upper faces 54 and 56 and ends 58 and 60 of second body pillow 44 is preferably sewn to fabric of like kind that covers the third longitudinal face of body pillow 44 that lies adjacent mat 12. In other words, the core material of second body pillow 44 is covered on all five faces with fabric, preferably terry cloth or cotton flannel.

Second body pillow 44 is not attached in a fixed location and orientation with respect to mat 12, but rather is removably attached thereto in a range of positions. Generally speaking, second body pillow 44 is disposed with one concavely curved longitudinal apex generally parallel to and adjacent side edge 24. Second body pillow 44 is curved concavely as viewed from a point offset away from side edge 24 of mat 12. Viewed from the opposite direction, i.e., from a point near the center of body portion 14 of mat 12, body pillow 44 would appear to be curved convexly.

To permit the location of second body pillow 44 to be adjusted relative to mat 12, a well-known hook and loop fabric fastener system 62 is employed. Fastener system 62 includes a first elongated strip component 64 having a plurality of fiber loops on the face thereof. Preferably, loop component 64 is attached to the top surface 18 of mat 12, with the loops facing upwardly. This arrangement is preferred because the loop component of the hook and loop fastener system is less scratchy than the hook portion, and the infant is more likely to come in contact with the portion attached to mat 12. Elongated loop component 64 is oriented transversely relative to the intended orientation of second pillow 44 and therefore lies generally parallel to and about halfway between edges 26 and 28, while extending inwardly from edge 24 toward the central area of body portion 14 of mat 12. Stitches 66 secure loop component 64 to mat 12.

Fastener system 62 further includes a second elongated strip component 68 having a plurality of hooks suitable for releasably engaging the loops of component 64 in well-known fashion. Hook component 68 is attached to the lower longitudinal face of second body pillow 44 with the loops facing downwardly toward mat 12 and toward loop component 64. Elongated hook component 68 is oriented transversely relative to second body pillow 44 and is affixed thereto by stitching about halfway between triangular ends 58 and 60, so as to overlie loop component 64 in normal use. Hook component 68 has a length equal to or less than the width of the face of second body pillow 44 to which it is affixed. Loop component 64 has a length greater than that of hook component 68, thereby permitting second body pillow 44 to be removably attached to mat 12 in a range of lateral positions relative to first body pillow 42.

Associated with mat 12 and comprising a further component of infant positioner 10 is a head positioner 70 that, in this first embodiment, is generally wedge-shaped. Head positioner 70 has a substantially rectangular base face 72 defined by opposite side edges 74 and 76, a shoulder edge 78, and a head edge 80. Edges 74 and 76 are generally parallel to each other and generally perpendicular to edges 78 and 80. Head positioner 70 has a first upper face 82 and a second upper face 84 extending upwardly from side edges 74 and 76, respectively, to meet at an apex 86. Head positioner 70 has a transverse cross-sectional configuration, i.e., in a direction generally parallel to edges 78 and 80, that is triangular. Foot end face 88 and head end face 90, which connect base face 72 to upper faces 82 and 84 are likewise triangular in configuration. In this first embodiment, the apex 86 is disposed substantially closer to one side edge 76 than to the other side edge 74 such that upper face 82 is substantially longer in the transverse direction than is upper face 84. In general, head positioner 70 can be described as wedge shaped with one upper face 82 sloping from near side edge 76 to side edge 74.

Base face 72, upper faces 82 and 84, and end faces 88 and 90 of head positioner 70 are all covered with a fabric material that preferably is the same as or similar to the fabric of which mat 12 is constructed, namely terry cloth or cotton flannel. The fabric covering faces 72, 82, 84, 88, 90 is preferably sewn together at the mating edges to form a continuous terry cloth covering surface. Edges 74, 76, 78 and 80 together form a continuous perimeter base edge 94 of head positioner 70 that is bound against ravelling by a single length of binding tape 96. The perimeter base edge 94 is overlapped by binding tape 96 which is folded lengthwise and stitched to head positioner 70 at stitch line 98. Binding tape 96 preferably comprises a woven fabric of synthetic material such as polyester or the like, the same as or similar to the binding tape 38 used with mat 12.

Head positioner 70 is attached to head portion 16 of mat 12. Preferably, the shoulder edge 78 of head positioner 70 overlaps the head edge 34 of head portion 16. The amount of overlap is a relatively small fraction of the length of head positioner 70 as defined by the distance between shoulder edge 78 and head edge 90. Preferably, the amount of overlap is about one inch. In this first embodiment, head positioner 70 is secured to head portion 16 of mat 12 by stitching the overlapping portions together.

Alternatively, head positioner 70 could be removably attached to head portion 16 by a hook and loop fabric fastener system similar to that used to removably attach second body pillow 44 to mat 12. If a hook and loop fastener system is employed, the hook component and the loop component would be affixed to respective ones of the overlapping portions of head positioner 70 and head portion 16 of mat 12. Preferably, the loop portion would be affixed to head portion 16 of mat 12, as the loop portion is less scratchy and the portion of the hook and loop fastener affixed to head portion 16 would be more likely to be contacted by the infant.

As a further alternative, a loop portion of the hook and loop fastener system could be affixed to head positioner 70 in two locations, one location being adjacent to edge 78 and the other being along edge 80. With such an arrangement, the orientation of head positioner 70 could be reversed so that the direction of slope of upper surface 82 could be reversed. By periodically removing, reversing the orientation, and reattaching head positioner 70 to mat 12, it can be assured that the infant will not sleep with its head turned in one direction more than the other.

In use, an infant 100 is placed on its back upon infant positioner 10 for sleeping. The infant's torso is disposed upon body portion 14 of mat 12, while the infant's head is disposed upon head positioner 70. Second body pillow 44 is moved closer to or farther away from first body pillow 42, as required to hold the infant snugly. The sloping upper face 82 of wedge-shaped head positioner 70 causes the sleeping infant's head to rotate sideways under the force of gravity such that the infant's head is facing toward the base of the slope. This rotation, or turning, of the infant's head prevents the infant from developing a flat spot on the back of the skull, since the weight of the head is borne on the side of the head rather than on the back of the head.

Figure 8:
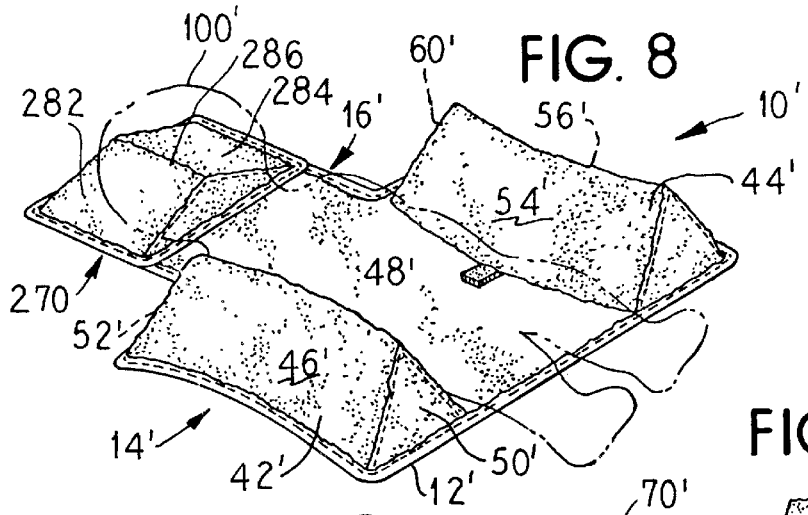
FIG. 8 is a perspective view of a second embodiment of an infant positioner configured in accordance with the present invention.
Figure 9:
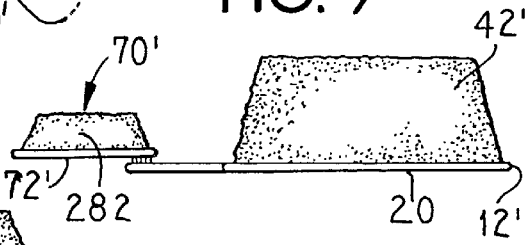
FIG. 9 is a side elevational view of the infant positioner of FIG. 8.
Figure 10:
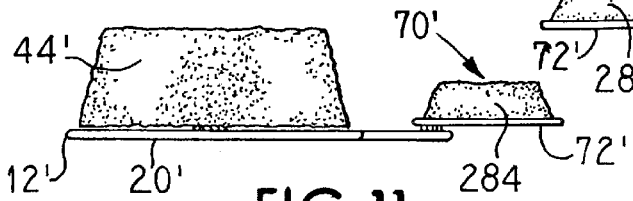
FIG. 10 is an opposite side elevational view of the infant positioner of FIG. 8.
Figure 12:
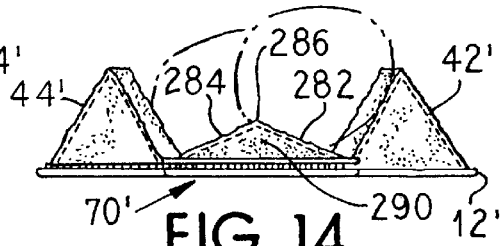
FIG. 12 is a head end view of the infant positioner of FIG. 8.
Figure 11:
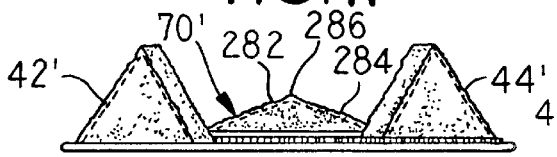
FIG. 11 is a foot end view of the infant positioner of FIG. 8.
Figure 13:
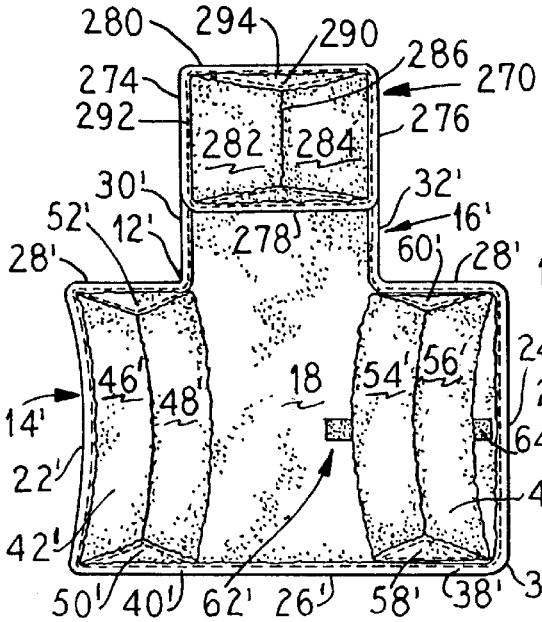
FIG. 13 is a top plan view of the infant positioner of FIG. 8.
Figure 14:
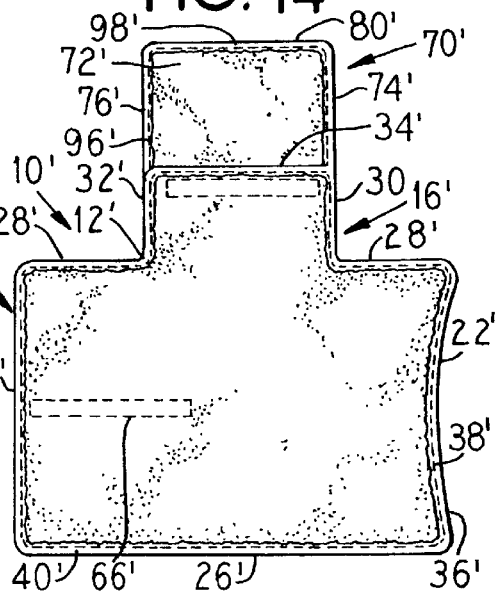
FIG. 14 is a bottom plan view of the infant positioner of FIG. 8.

Referring to FIGS. 8–14, there is illustrated an infant positioner 10', comprising a second embodiment of the present invention. Infant positioner 10' is in many respects substantially identical to the first embodiment of the present invention embodied in infant positioner 10 shown in FIGS. 1–7. To avoid unnecessary duplication, those elements of the second embodiment that are identical to the elements of the first embodiment described above will not be described again. To facilitate reference to and application of the description of the first embodiment above to the second embodiment, like elements are designated with like primed reference numerals. Those elements of the second embodiment that differ from but generally correspond to elements of the first embodiment are designated with like reference numerals in the 200 series.

Again referring to FIGS. 8–14, associated with mat 12' and comprising a further component of infant positioner 10' is a head positioner 270 that, in this second embodiment, is generally pyramid-shaped. Head positioner 270 has a substantially rectangular base face 272 defined by opposite side edges 274 and 276, a shoulder edge 278, and a head edge 280. Edges 274 and 276 are generally parallel to each other and generally perpendicular to edges 278 and 280. Head positioner 270 has a first upper face 282 and a second upper face 284 extending upwardly from side edges 274 and 276, respectively, to meet at an apex 286. Head positioner 270 has a transverse cross-sectional configuration, i.e., in a direction generally parallel to edges 278 and 280, of an isosceles triangle. Foot end face 288 and head end face 290, which connect base face 272 to upper faces 282 and 284 are likewise configured as isosceles triangles. In this second embodiment, the apex 286 is disposed substantially midway between side edge 276 and side edge 274 such that upper face 282 is substantially the same length in the transverse direction as upper face 284. In general, head positioner 270 can be described as pyramid-shaped with both. upper faces 282 and 284 sloping equally from apex 286 to side edges 274 and 276, respectively.

Base face 272, upper faces 282 and 284, and end faces 288 and 290 of head positioner 270 are all covered with a fabric material that preferably is the same as or similar to the fabric of which mat 12' is constructed, namely terry cloth. The fabric covering faces 272, 282, 284, 288, and 290 is preferably sewn together at the mating edges to form a continuous terry cloth or cotton flannel covering surface. Edges 274, 276, 278 and 280 together form a continuous perimeter base edge 294 of head positioner 270 that is bound against ravelling by a single length of binding tape 296. The perimeter base edge 294 is overlapped by binding tape 296 which is folded lengthwise and stitched to head positioner 270 at stitch line 298. Binding tape 296 preferably comprises a woven fabric of synthetic material such as polyester or the like, the same as or similar to the binding tape 38' used with mat 12'.

Head positioner 270 is attached to head portion 16' of mat 12'. Preferably, the shoulder edge 278 of head positioner 270 overlaps the head edge 34' of head portion 16'. The amount of overlap is a relatively small fraction of the length of head positioner 270 as defined by the distance between shoulder edge 278 and head edge 290. Preferably, the amount of overlap is about one inch. Head positioner 270 is removably attached to head portion 16' of mat 12' by a hook and loop fabric fastener system similar to that used to removably attach second body pillow 44' to mat 12'. The hook component and the loop component are affixed to respective ones of the overlapping portions of head positioner 270 and head portion 16' of mat 12'. Preferably, the loop portion is affixed to head portion 16' of mat 12', as the loop portion is less scratchy and the portion of the hook and loop fastener affixed to head portion 16' would be more likely to be contacted by the infant. Alternatively, head positioner 270 could be removably attached to head portion 16' by stitching the overlapping portions together as in the first embodiment.

In use, an infant 100' is placed on its back upon infant positioner 10' for sleeping. The infant's torso is disposed upon body portion 14' of mat 12', while the infant's head is disposed upon head positioner 270. Second body pillow 244 is moved closer to or farther away from first body pillow 242, as required to hold the infant snugly. The sloping upper faces 282 and 284 of pyramid-shaped head positioner 270 cause the sleeping infant's head to rotate sideways under the force of gravity such that the infant's head is facing toward the base of one or the other of the slopes. The symmetrical configuration of head positioner 270 does not provide a bias toward one side or the other, and the caregiver can alternate placement of the infant's head to one side or the other at each use of infant positioner 10'. This rotation, or turning, of the infant's head prevents the infant from developing a flat spot on the back of the skull, since the weight of the head is borne on one side of the head or the other, rather than on the back of the head.

While the present invention has been described in detail in terms of preferred embodiments, the description is illustrative only and no limitation of the scope of the invention is intended thereby. The scope of the invention in which applicant is claiming exclusive rights is defined by the claims below.

I claim:

1. A positioner for positioning an infant in a supine position for sleeping and for reducing the risk of developing positional plagiocephaly while sleeping in a supine position, comprising in combination:

a mat having a generally rectangular body portion having opposite sides and opposite ends, and a generally rectangular head portion having opposite sides and opposite ends whose respective widths are less than the corresponding widths of said body portion opposite sides and opposite ends, and one end of said head portion being associated with and extending outwardly from a medial portion of one side of said body portion;

first and second elongated pillows, each having an elongated flat base and an elongated crest region located in upwardly spaced relationship to said base, each having elongated opposite sides that generally decline in transverse width relative to each other with increasing upward distance from said base to said crest, and having a longitudinal curvature such that each of said first and said second elongated pillows when viewed from a point near the center of said body portion can appear to be convexly curved, mounting means for fixing said base of said first elongated pillow over said mat along one end of said body portion, and hook and loop fastener means associated with said base of said second elongated pillow and with said matt adjacent to the other one of said ends of said body portion so that said base of said second elongated pillow is releasably engageable over said mat at various orientations relative to said mat; and a head positioner having a generally rectangular, flattened bottom, opposed sides, and first and second opposed ends, and an elongated apex region extending generally perpendicularly in a region between said head positioner opposed sides and extending in upwardly spaced relationship relative to said bottom, said first and said second opposed ends each being generally flattened and each said opposite end being inclined relative to the other so that the transverse width therebetween generally declines with increasing upward distance from said bottom to said apex, and fastening means for fastening said flattened bottom over said matt with one side of said head positioner being adjacent to the other end of said head portion;

whereby, when an infant is located in a supine position between said first and said second elongated pillows with the head of said infant resting on said head positioner, said head is caused to turn in a direction that is opposite to the location of said apex relative to said head.

2. The positioner of claim 1 wherein said apex is located nearer to one of said head positioner opposed sides that the other, and said first opposed end has a larger surface area than said second opposed end so that the inclination angle of said first opposed end is smaller than the inclination angle of said second opposed end, whereby, when said head rests upon said first opposed end, said head is caused to turn away from said location of said apex relative to said head.

3. The positioner of claim 1 wherein said apex is medially located between said first and said second opposed ends so that the inclination angle of said first opposed end is about equal to the inclination angle of said second opposed end whereby, when said head rests upon said head positioner, said head is caused in a direction that is away from said location of said apex relative to said head.

4. The positioner of claim 1 wherein each of said first and said second longitudinal pillows has a triangular cross-sectional configuration.

5. The positioner of claim 4 wherein said cross-sectional configuration is approximately that of an equilateral triangle.

6. The positioner of claim 1 wherein surface portions thereof are covered with a soft, absorbent fabric.

7. The positioner of claim 1 wherein the orientation of said head positioner relative to said mat body portion is adjustable so that the direction of slope of said first opposed end relative to said second opposed end can be reversed, and said adjustability is provided by hook and loop fastening means.

* * * * *

UNITED STATES PATENT AND TRADEMARK OFFICE

CERTIFICATE OF CORRECTION

PATENT NO. : 6,473,923 B1
DATED : November 5, 2002
INVENTOR(S) : Mariann C. Straub It is certified that error appears in the above-identified patent and that said Letters Patent is hereby corrected as shown below:

Column 1,
Line 4, delete “patent” and insert -- Patent --.
Line 5, delete “application” and insert -- Application --.

Column 6,
Line 45, after “both” delete “ .”

Column 7,
Line 63, before “having”insert -- each --.

Signed and Sealed this

Twenty-ninth Day of June, 2004

JON W. DUDAS
*Acting Director of the United States Patent and Trademark Office*